US005829068A

United States Patent [19]

Smith

[11] Patent Number: 5,829,068

[45] Date of Patent: Nov. 3, 1998

[54] TOILET SEAT RAISING AND LOWERING DEVICE

[76] Inventor: Darence L. Smith, 1209 E. 166th Pl., South Holland, Ill. 60473

[21] Appl. No.: 861,524

[22] Filed: May 22, 1997

[51] Int. Cl.[6] ..... A47K 13/10

[52] U.S. Cl. ..... 4/246.3

[58] Field of Search ..... 4/246.3, 246.4, 4/246.5

[56] References Cited

U.S. PATENT DOCUMENTS

| | | | |
|---|---|---|---|
| 428,001 | 5/1890 | Kaley | 4/246.3 |
| 2,088,050 | 7/1937 | Brown | 4/246.4 |
| 4,470,161 | 9/1984 | Seabrooke | 4/246.3 |
| 4,975,988 | 12/1990 | Won | 4/246.3 |

*Primary Examiner*—Robert M. Fetsuga

[57] ABSTRACT

A toilet seat raising and lowering device including a joint member that has a first end and a second end with each end having an axle rod projecting outwardly therefrom. A pair of flat mounting brackets that are interconnected with the joint member for coupling to a seat of a toilet. Included is a pedal that has a base member and a foot member pivotally coupled about an axis. The foot member is capable of recoiling away from the base member. A pair of L-shaped members are provided. Each L-shaped member has an upper cylindrical coupler with an opening, and a lower cylindrical coupler with an opening. Lastly, provided are a pair of cables with one of each within one of the pair of L-shaped members. The pair of cables extend into the upper and lower coupler for engaging the applicable axle rod and axis. The pair of cables are capable of rotating the joint member for lifting of the toilet seat when an external force applies downward pressure on the foot member of the pedal.

1 Claim, 3 Drawing Sheets

TOILET SEAT RAISING AND LOWERING DEVICE

BACKGROUND OF THE INVENTION

1. Field of the Invention

The present invention relates to a toilet seat raising and lowering device and more particularly pertains to providing mechanism that may be applied to existing toilets for raising and lowering the seat.

2. Description of the Prior Art

The use of a device for raising a toilet seat is known in the prior art. More specifically, Devices for raising toilet seats heretofore devised and utilized for the purpose of raising a toilet seat with out touching the seat are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 5,404,595 to Carmel discloses a device for raising a toilet seat. U.S. Pat. No. 5,323,496 to Blair discloses a toilet seat lifting apparatus. U.S. Pat. No. 5,237,708 to Zamoyski discloses a foot actuated toilet seat lifting, anti-slamming, and reseating device. U.S. Pat. No. 5,075,906 to Robbins discloses a seat lift. U.S. Pat. No. 4,534,073 to Smith discloses a toilet seat lifter. Lastly, U.S. Pat. No. 4,150,446 to Crocker discloses a toilet seat lifter.

In this respect, the toilet seat raising and lowering device according to the present invention substantially departs from the conventional concepts and designs of the prior art, and in so doing provides an apparatus primarily developed for the purpose of providing mechanism that may be applied to existing toilets for raising and lowering the seat.

Therefore, it can be appreciated that there exists a continuing need for a new and improved toilet seat raising and lowering device which can be used for providing mechanism that may be applied to existing toilets for raising and lowering the seat. In this regard, the present invention substantially fulfills this need.

SUMMARY OF THE INVENTION

In view of the foregoing disadvantages inherent in the known types of Devices for raising toilet seats now present in the prior art, the present invention provides an improved toilet seat raising and lowering device. As such, the general purpose of the present invention, which will be described subsequently in greater detail, is to provide a new and improved toilet seat raising and lowering device which has all the advantages of the prior art and none of the disadvantages.

To attain this, the present invention essentially comprises a generally cylindrical joint member that has a first end and a second end. The joint member has a diameter of about 2.5 cm. The first end and the second end each have an axle rod projecting outwardly therefrom. Each axle rod has a diameter of about ⅓ the diameter of the joint member. Each axle rod has a groove. A pair of flat mounting brackets are interconnected with the joint member. One of the flat mounting brackets is spaced from the first end with another of the pair of flat mounting brackets spaced from the second end. Each mounting bracket is coupled to a seat of a toilet. Included is a pedal that has a base member and a foot member being pivotally coupled about an axis. The axis has a pair of end members with each having a groove. The foot member is depressed by an external force for collapsing onto the base member. Also, provided is a resilient means that is clamped to the axis and engages the base member and the foot member. The resilient means is capable of allowing the foot member to recoil away from the base member upon removal of the external force. A pair of L-shaped members are included. Each has an upper end and a lower end. The upper end of each L-shaped member has an upper cylindrical coupler with an opening. The lower end of each L-shaped member has a lower cylindrical coupler with an opening. Lastly, a pair of cables are included. One of each of the pair of cables is within one of the pair of L-shaped members. Each of the cables have an upper loop member that is within the upper cylindrical coupler, and a lower loop member that is within the lower cylindrical coupler. The upper cylindrical coupler of each L-shaped member engages the applicable axle rod of the joint member. The lower cylindrical coupler of each L-shaped member engages the applicable axis of the pedal. The upper loop member is positioned within the groove of the applicable axle rod when the upper cylindrical coupler is coupled to the axle rod. The lower loop member is positioned within the groove of the applicable axis when the lower cylindrical coupler are coupled to the axis. The pair of cables are capable of rotating the joint member for lifting of the toilet seat when the external force applies downward pressure on the foot member of the pedal.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved toilet seat raising and lowering device which has all the advantages of the prior art Devices for raising toilet seats and none of the disadvantages.

It is another object of the present invention to provide a new and improved toilet seat raising and lowering device which may be easily and efficiently manufactured and marketed.

It is a further object of the present invention to provide a new and improved toilet seat raising and lowering device which is of a durable and reliable construction.

An even further object of the present invention is to provide a new and improved toilet seat raising and lowering device which is susceptible of a low cost of manufacture with regard to both materials and labor, and which accordingly is then susceptible of low prices of sale to the consuming public, thereby making such toilet seat raising and lowering device economically available to the buying public.

Still yet another object of the present invention is to provide a new and improved toilet seat raising and lowering device which provides in the apparatuses and methods of the prior art some of the advantages thereof, while simultaneously overcoming some of the disadvantages normally associated therewith.

Still another object of the present invention is to providing mechanism that may be applied to existing toilets for raising and lowering the seat.

Lastly, it is an object of the present invention to provide a new and improved toilet seat raising and lowering device including a joint member that has a first end and a second end with each end having an axle rod projecting outwardly therefrom. A pair of flat mounting brackets that are interconnected with the joint member for coupling to a seat of a toilet. Included is a pedal that has a base member and a foot member pivotally coupled about an axis. A resilient means is clamped to the axis and engages the base member and the foot member. A pair of L-shaped members are provided. Each L-shaped member has an upper cylindrical coupler with an opening, and a lower cylindrical coupler with an opening. Lastly, provided are a pair of cables with one of each within one of the pair of L-shaped members. The pair of cables extend into the upper and lower coupler for engaging the applicable axle rod and axis. The pair of cables are capable of rotating the joint member for lifting of the toilet seat when an external force applies downward pressure on the foot member of the pedal.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
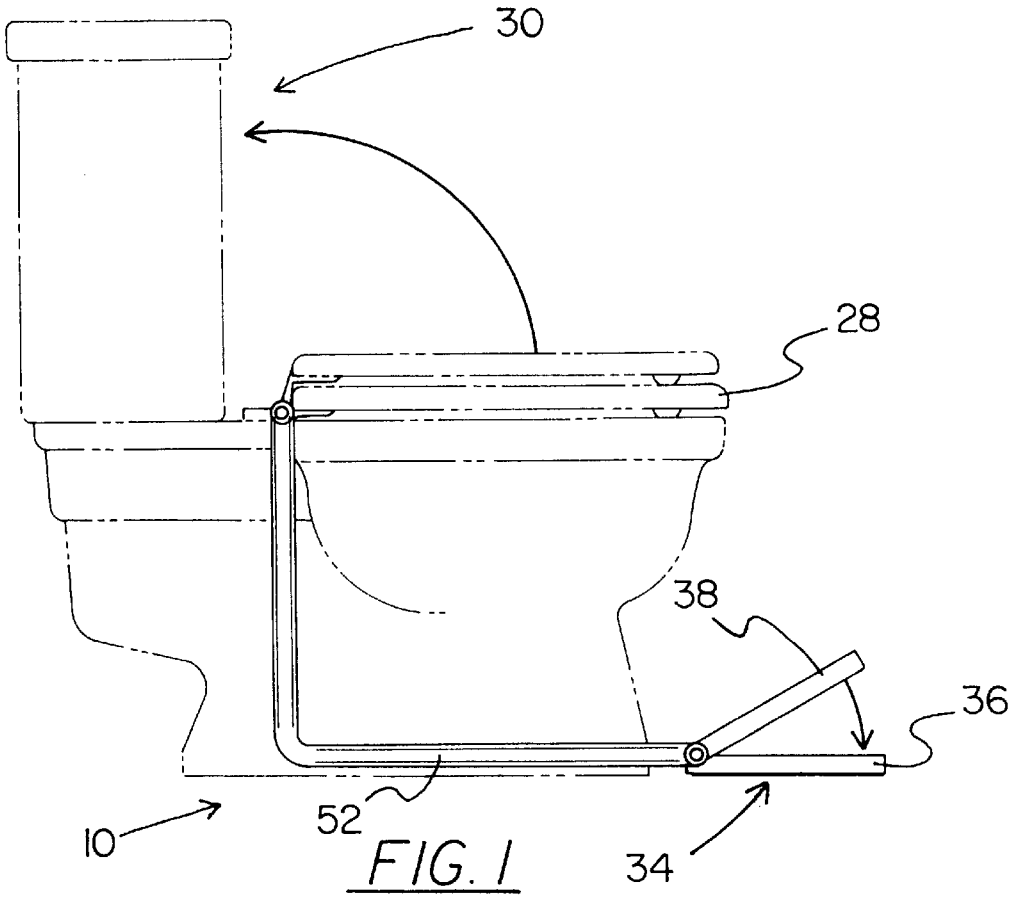
FIG. 1 is a perspective illustration of the preferred embodiment of the toilet seat raising and lowering device constructed in accordance with the principles of the present invention.

With reference now to the drawings, and in particular to FIG. 1 thereof, a new and improved toilet seat raising and lowering device embodying the principles and concepts of the present invention and generally designated by the reference numeral 10 will be described.

The present invention, the new and improved toilet seat raising and lowering device, is comprised of a plurality of components. Such components in their broadest context include a joint member, pedal and L-shaped member. Such components are individually configured and correlated with respect to each other so as to attain the desired objective.

Figure 5:
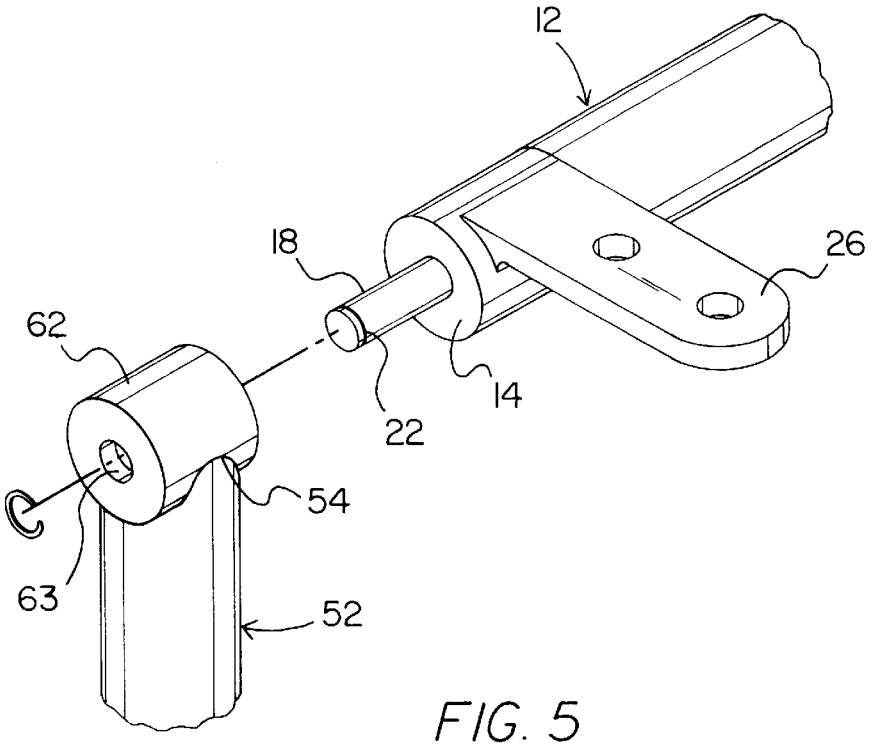
FIG. 5 is an exploded view of the coupling of the L-shaped member and the joint member.

More specifically, it will be noted that the present invention toilet seat raising and lowering device has a generally cylindrical joint member 12. The joint member has a first end 14 and a second end 16. The joint member has a diameter of about 2.5 cm. The first end and the second end each have an axle rod 18. FIG. 5 shows the axle rod of the first end projecting outwardly therefrom. The axle rod of the second end projects therefrom in an identical manner. Each axle rod has a diameter of about ⅓ the diameter of the joint member. Each axle rod having a groove 22 extending therearound.

Figure 2:
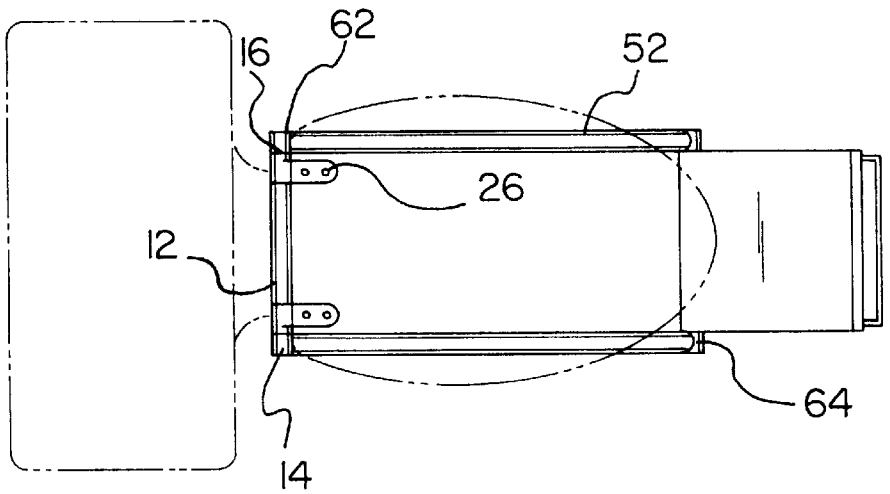
FIG. 2 is a top plan view of the present invention as seen in FIG. 1.

As illustrated in FIG. 2, a pair of flat mounting brackets 26 are interconnected with the joint member 12. One of each of the pair of flat mounting brackets is spaced from the first end 14. Another of each of the pair of mounting brackets is spaced from the second end 16. Each mounting bracket is coupled to a seat 28 of a toilet 30.

Figure 6:
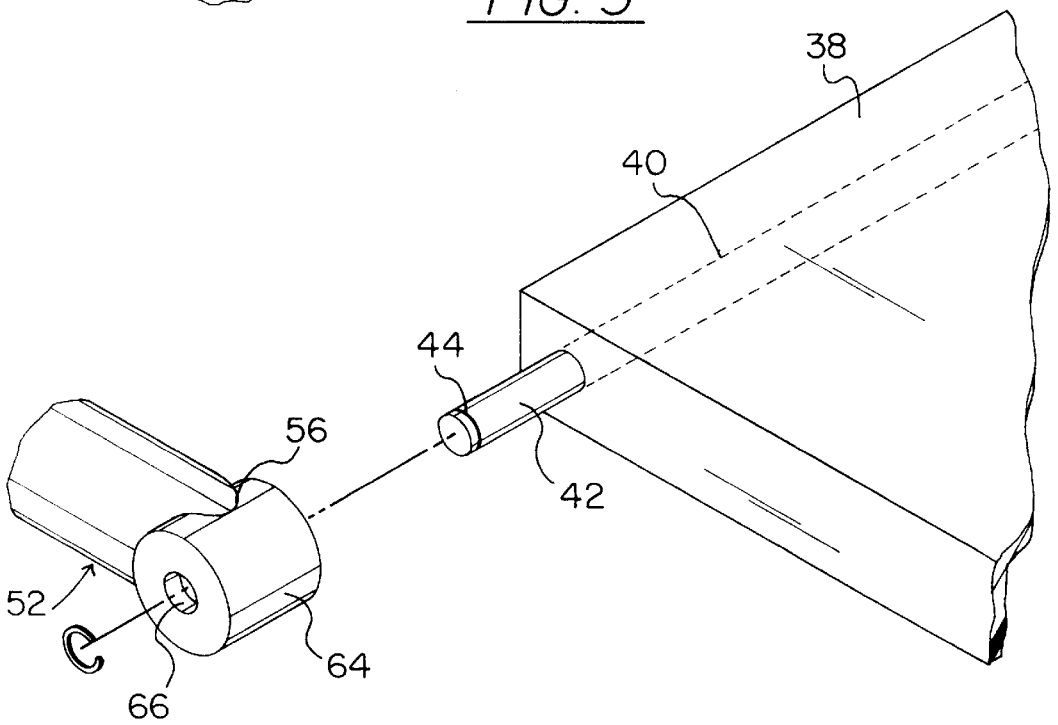
FIG. 6 is an exploded view of the coupling of the pedal and the joint member.

Also, a pedal 34 is provided. Th pedal has a base member 36 and a foot member 38, as depicted in FIG. 1. The foot member and the base member are each pivotally coupled about an axis 40. The axis has a pair of end members 42 with each having a groove 44 therearound, as seen in FIG. 6. The foot member, as shown in FIG. 1, may be depressed by an external force for collapsing onto the base member.

Figure 4:
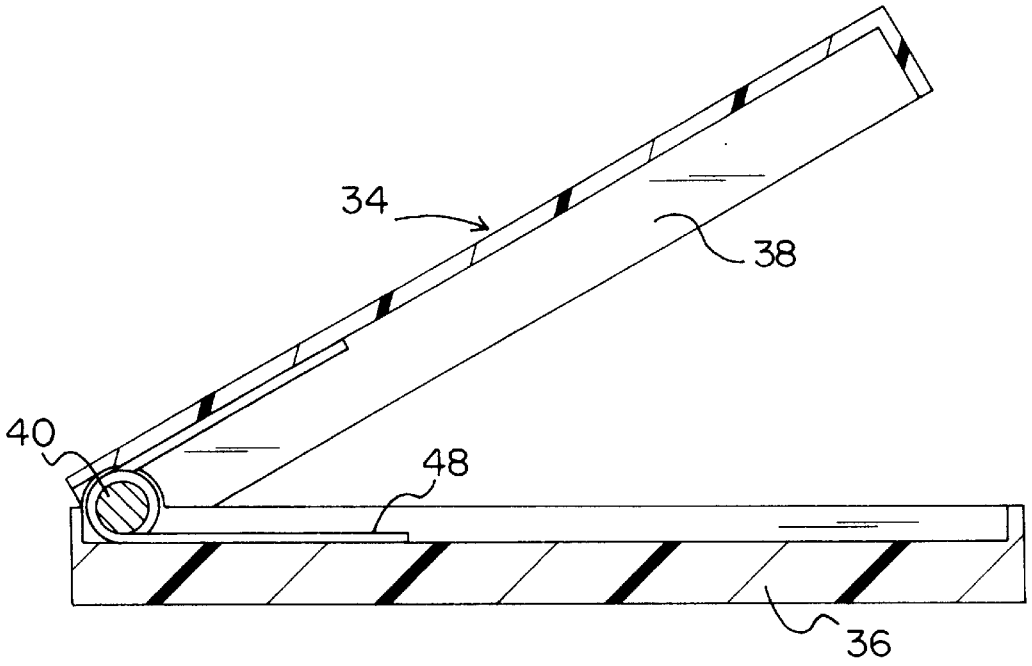
FIG. 4 is a cross-sectional view of the pedal of FIG. 1.

Additionally, a resilient means 48 is clamped to the axis 40. FIG. 4 shown the resilient means engaging the base member 36 and the foot member 38. The resilient means allows the foot member to recoil away from the base member upon removal of the external force.

A pair of L-shaped members 52 are included. The L-shaped members, as shown in FIG. 2, are each made of plastic. Each has an upper end 54 and a lower end 56. The upper end of each L-shaped member has an upper cylindrical coupler 62 with an opening 63. The lower end of each L-shaped member has a lower cylindrical coupler 64 with an opening 66.

Figure 3:
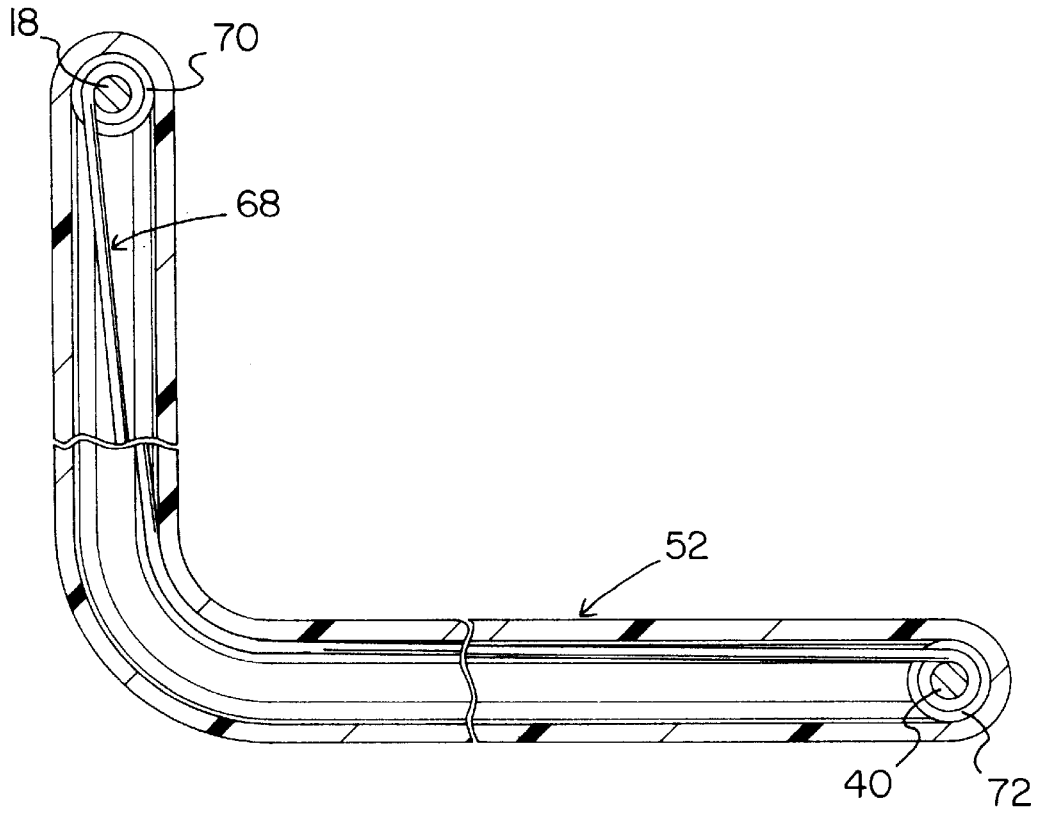
FIG. 3 is a cross-sectional view of the L-shaped members of FIGS. 1 and 2.

Lastly, a pair of cables 68 are provided, with one of each within one of the pair of L-shaped members. The cables are each formed from a steel or aluminum alloy. As shown in FIG. 3, each of the cables have an upper loop member 70 that is within the upper cylindrical coupler 62, and a lower loop member 72 that is within the lower cylindrical coupler 64. The upper cylindrical coupler of each L-shaped member engages the applicable axle rod of the joint member to be positioned flush with the joint member. The lower cylindrical coupler of each L-shaped member engaging the applicable axis of the pedal to be positioned flush with the foot member. The upper loop member is positioned within the groove 22 of the applicable axle rod when the upper cylindrical coupler is coupled to the axle rod. The lower loop member is positioned within the groove 44 of the applicable axis when the lower cylindrical coupler is coupled to the axis. The pair of cables are capable of rotating the joint member for lifting of the toilet seat when the external force applies downward pressure on the foot member of the pedal.

The present invention enables the user to easily raise and lower the seat of the toilet by stepping on the pedal. The pedal is located in the front of the toilet base for convenience to the user. The dual cable system is used to raise and lower the toilet seat to provide balanced rotation of the seat and remove any strain caused by having the device connected to just one side of the seat. The toilet seat raising and lowering device is made of a pedal which is connected to a spring loaded axis that pushes the foot member up to its original position. This pedal is also connected to steel or aluminum alloy cables covered with flexible plastic. The cables housed within the plastic forms the L-shaped member that run along the sides of the toilet and up the back to the seat. The cable has two series of rotational pivot points, up near the top where it is attached to the joint member, and down at the bottom where it is connected to the axis of the pedal. As the pedal is depressed, the cable is pulled in a downward motion, and therefore raises, the toilet seat to an upright position. Once the user's foot leaves the foot member of the pedal, to remove the external force, the weight of the seat and the spring-loaded axis of the pedal, allows the seat to return to its original down position. The present invention may be installed on any style and make of existing toilet seats.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A toilet seat raising and lowering device comprising in combination:

a toilet with a seat;

a generally cylindrical joint member having a first end and a second end, the joint member having a diameter of about 2.5 cm, the first end and the second end each having an axle rod projecting outwardly therefrom past a periphery of the toilet, each axle rod having a diameter of about ⅓ the diameter of the joint member, each axle rod having a groove therearound, a pair of flat mounting brackets being interconnected with the joint member, one of the flat mounting brackets being spaced from the first end with another of the mounting brackets being spaced from the second end, each mounting bracket being coupled to the seat of the toilet;

a pedal having a base member and a foot member being pivotally coupled about an axis, the axis having a pair of end members with each having a groove therearound, the foot member being depressed by an external force for collapsing onto the base member;

a resilient means being clamped to the axis and engaging the base member and the foot member, the resilient means being capable of allowing the foot member to recoil away from the base member upon removal of the external force;

a pair of plastic L-shaped members with each having an upper rear vertical extent with an upper end and a lower front horizontal extent with a lower end, the upper end of each L-shaped member having an upper cylindrical coupler with an opening therethrough, the lower end of each L-shaped member having a lower cylindrical coupler with an opening therethrough; and a pair of cables with one of each within one of the pair of L-shaped members, each of the cables having an upper loop member being within the upper cylindrical coupler and a lower loop member being within the lower cylindrical coupler, the upper cylindrical coupler of each L-shaped member engaging the applicable axle rod of the joint member with the joint member, the lower cylindrical coupler of each L-shaped member engaging the applicable axis of the pedal the upper loop member being positioned within the groove of the applicable axle rod when the upper cylindrical coupler being coupled to the axle rod, the lower loop member being positioned within the groove of the applicable axis when the lower cylindrical coupler being coupled to the axis, the pair of cables being capable of providing balanced rotation of the joint member for lifting of the toilet seat when the external force applies downward pressure on the foot member of the pedal.

* * * * *